US006098857A

United States Patent [19]

Le Gal

[11] Patent Number: 6,098,857

[45] Date of Patent: Aug. 8, 2000

[54] BACKPACK BABY CARRIER

[75] Inventor: Yann Le Gal, Voreppe, France

[73] Assignee: Lafuma S.A., Anneyron, France

[21] Appl. No.: 09/315,670

[22] Filed: May 20, 1999

[30] Foreign Application Priority Data

May 25, 1998 [FR] France ..... 98 06707

[51] Int. Cl.[7] ..... A45F 3/08

[52] U.S. Cl. ..... 224/161; 224/153

[58] Field of Search ..... 224/160, 161, 224/153

[56] References Cited

U.S. PATENT DOCUMENTS

| | | | |
|---|---|---|---|
| 2,346,989 | 4/1944 | O'Brien | 224/155 |
| 5,626,271 | 5/1997 | Messey et al. | 224/161 |
| 5,692,655 | 12/1997 | Fair et al. | 224/160 |

FOREIGN PATENT DOCUMENTS

| | | |
|---|---|---|
| 0719513 | 7/1996 | European Pat. Off. . |
| 2728446 | 6/1996 | France . |
| 3243297 | 5/1984 | Germany . |
| 9716089 | 5/1997 | WIPO . |

*Primary Examiner*—Linda J. Sholl
*Attorney, Agent, or Firm*—Wall Marjama Bilinski & Burr

[57] ABSTRACT

The backpack baby carrier is noteworthy in that it comprises a T-shaped support frame of which the central arm (2*a*) is vertical and able to act as a supporting surface for a rigid seat of adjustable position (3) so that the position of the seat can be adapted to suit the size of the child and in that the shaped horizontal upper arm (2*b*) of the frame is fastened at each end to a connecting means (4) of a means (5) for stabilizing the carrier and enabling it to be rested on the ground, said support frame being constructed so as to take protective and wearing means of the shoulder straps and belt type.

14 Claims, 6 Drawing Sheets

BACKPACK BABY CARRIER

The invention relates to a backpack baby carrier from the technical field of means of carrying babies.

There are many baby carriers constructed with equipment comprising a harness on the market.

One problem is that these products are designed for a single size of child and it is therefore necessary to change them relatively rapidly to keep pace with the morphology and growth of the child.

A second problem that is encountered is that present-day carriers are not independent in themselves, in the sense that they cannot be used except by wearing them.

Another drawback is that present-day carriers are not always comfortable and do not allow the child to rest and relax, especially in the lower limbs.

One object according to the invention has therefore been to devise a backpack baby carrier that may be usable by adapting to the changes of size of the child while keeping the child comfortable.

Another object according to the invention has been to devise a backpack baby carrier that can act as an independent seat component that is stable relative to a surface on which it rests on the ground, for example, independently of actually being worn.

Another object has been to devise a backpack baby carrier which keeps the child comfortable at all times.

A first feature is that the backpack baby carrier is noteworthy in that it comprises a T-shaped support frame of which the central arm is vertical and able to act as a supporting surface for a rigid seat whose position is adjustable, so that the position of the seat can be adapted to suit the size of the child and in that the shaped horizontal upper arm of the frame is fastened at each end to a connecting means of a rod for stabilizing the carrier and enabling it to be rested on the ground, said support frame being constructed so as to take protective and wearing means of the shoulder straps and belt type.

Another feature is that the baby carrier is constructed to take a thermoformed shell able to act as an enclosing assembly that fits into the support frame and forms a backrest with a headrest shape at its upper end and a footrest shape at its lower end.

These features and others also will be clearer from the description which follows.

In order to clarify the subject of the invention without, however, limiting it, in the appended drawings.

Figure 1:
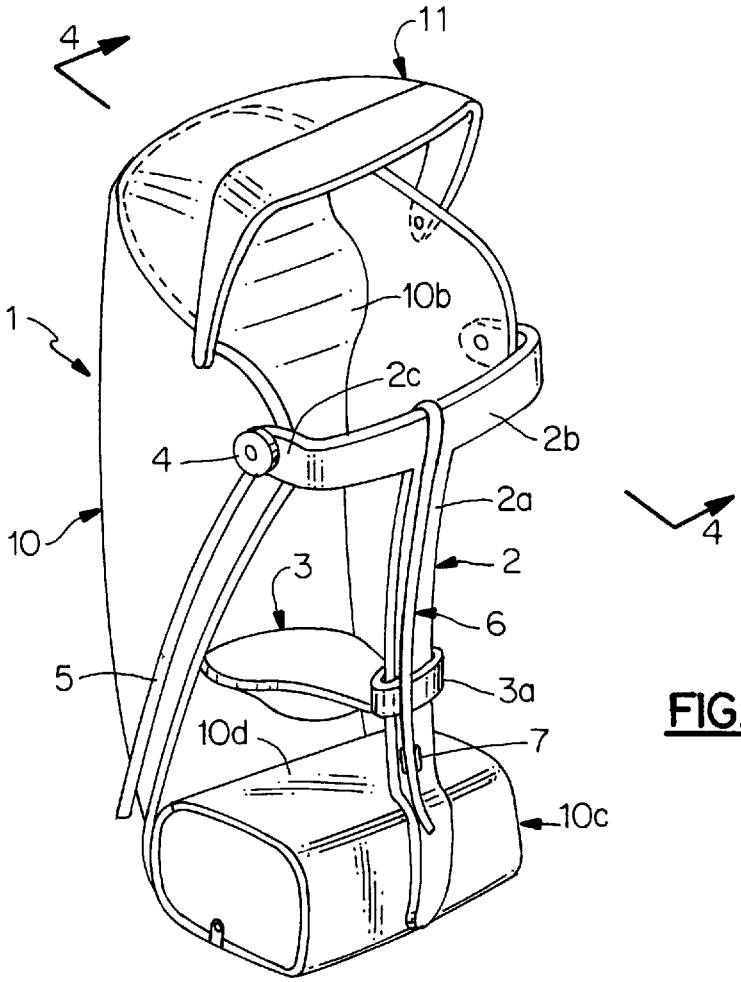
FIG. 1 is a view of a backpack baby carrier according to the invention shown in perspective.

In order to render the subject of the invention more concrete, it will now be described in a non-restrictive embodiment illustrated in the figures of the drawings.

The backpack baby carrier has the overall reference number (1). It comprises a T-shaped support frame (2) of which the central arm (2*a*) is vertical, and able to act as a supporting surface for a rigid seat (3) whose position is adjustable so that it is possible to adapt the position of said seat to suit the size of the child. The support frame has at its top end a horizontal arm (2*b*), advantageously of curvilinear form. The ends (2*c*) of said arms (2*b*) are advantageously each fixed in end piece connectors (4) produced in the form of, for example, a disk. The end pieces (4) at each side of the frame are provided with internal bores to take the arms of a stand (5) forming a stabilizer. This stabilizing element may consist of a U shape with a central part for resting on the ground.

In a variant, the stand may consist simply of two arms forming rods that rest directly on the ground. Said stand is advantageously hinged to the end pieces to allow it to tilted and folded.

According to the invention, said seat (3) is ergonomically shaped so that the child is comfortably supported. In an initial embodiment illustrated in FIGS. 1–4, this seat is made of a rigid material and is secured by a component forming a slide block (3*a*) that is able to move up and down the central arm (2*a*) of the support frame. Different ways of adjusting the positioning of the seat (3) supporting slide block (3*a*) are possible. One way for example is with the aid of a strap (6), part (6*a*) of which is fastened to the inside face of the slide block (3*a*), which passes over the horizontal arm (2*b*) of the frame by any fixed deflection means (7) while the other end (6*b*) of the strap is attached and fixed to a connection means (8) located on the front face of the arm (2*a*) of the frame. The position of the strap may be adjustable with the aid of a tightening buckle of known type (7) or other means.

Figure 4:
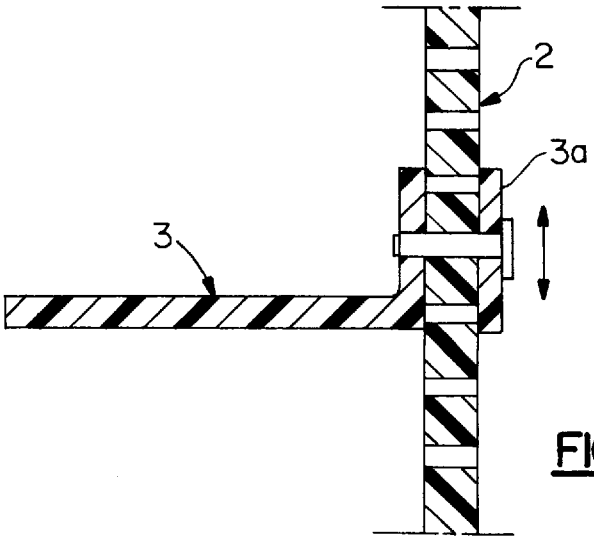
FIG. 4 is a partial view in section illustrating an alternative form of seat adjustment.

In a variant, FIG. 4, the central arm may be constructed with, along its height, a plurality of holes able to take said seat at different levels by means of its slide block, in which case a locking means of the pin type is used. In another arrangement, a textile assembly (8*a*) for protecting the back of the wearer is attached and fixed detachably and releasably along the support frame, along its central arm and along its upper part. This textile protection is fixed in any appropriate way with the aid of touch-and-close means able to engage with, for example, complementary touch-and-close zones fixed to the visible surface of said support frame.

Said textile protection is also provided at its upper end with a configuration capable of protecting the horizontal arms of said frame, in which case there are shoulder strap elements (9) or harness elements fixed by one end to the textile protection so as to be worn by the user.

Another feature of the invention is that the support frame is able to take, by an appropriate fixing means, a thermoformed shell (10) able to act as an enclosing assembly that fits into the support frame and forms a backrest (10*a*) with a headrest shape (10*b*) at its upper end and footrest shape (10*c*) at its lower end. This thermorformed shell is made from any material with an appropriate textile covering. In an original manner, this component is advantageously all one piece and exhibits at its lower end a shape (10*d*) whose volumetric configuration is a parallelepiped or cylinder and whose top plane can act as a footrest.

In an initial configuration, it may be envisaged that this lower shape may have openings (10*e*) on either side for storage of accessories or various items such as clothing.

Figure 7:
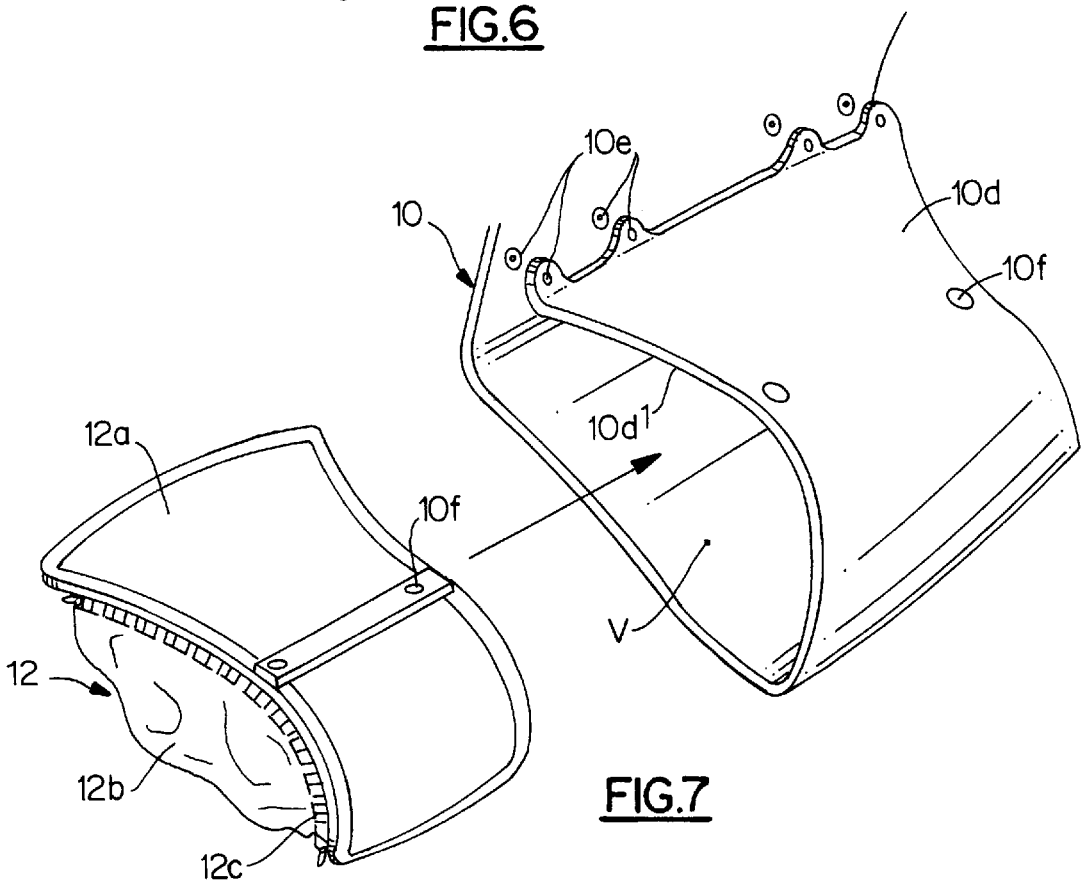
FIG. 7 is a partial view of the lower end of the backpack baby carrier illustrating the configuration of the footrest and the insertion of a storage bag.

In the configuration illustrated in FIG. 7, the thermoformed shell forming the envelope (10) incorporates at its lower end an end forming a fold (10*d*) forming the footrest zone by its top surface. The fold part is fixed by press studs (10*e*) or the equivalent to the inside of the envelope (10). A volume (V) is thus defined, in which a storage bag (12) can be fixed. This bag may be fixed to the inside (10*d*1) of the fold (10*d*) by any appropriate means, such as press studs (10*f*) or touch-and-close fasteners or the like. Installation or removal of the bag is quick and easy. This bag is advantageously produced with a rigid wall (12*a*) designed to be placed against the inside of the flap (10*d*) and a flexible wall (12*b*), the internal volume being accessible through a zipper (12*c*), for example, or other equivalent system.

Figure 2:
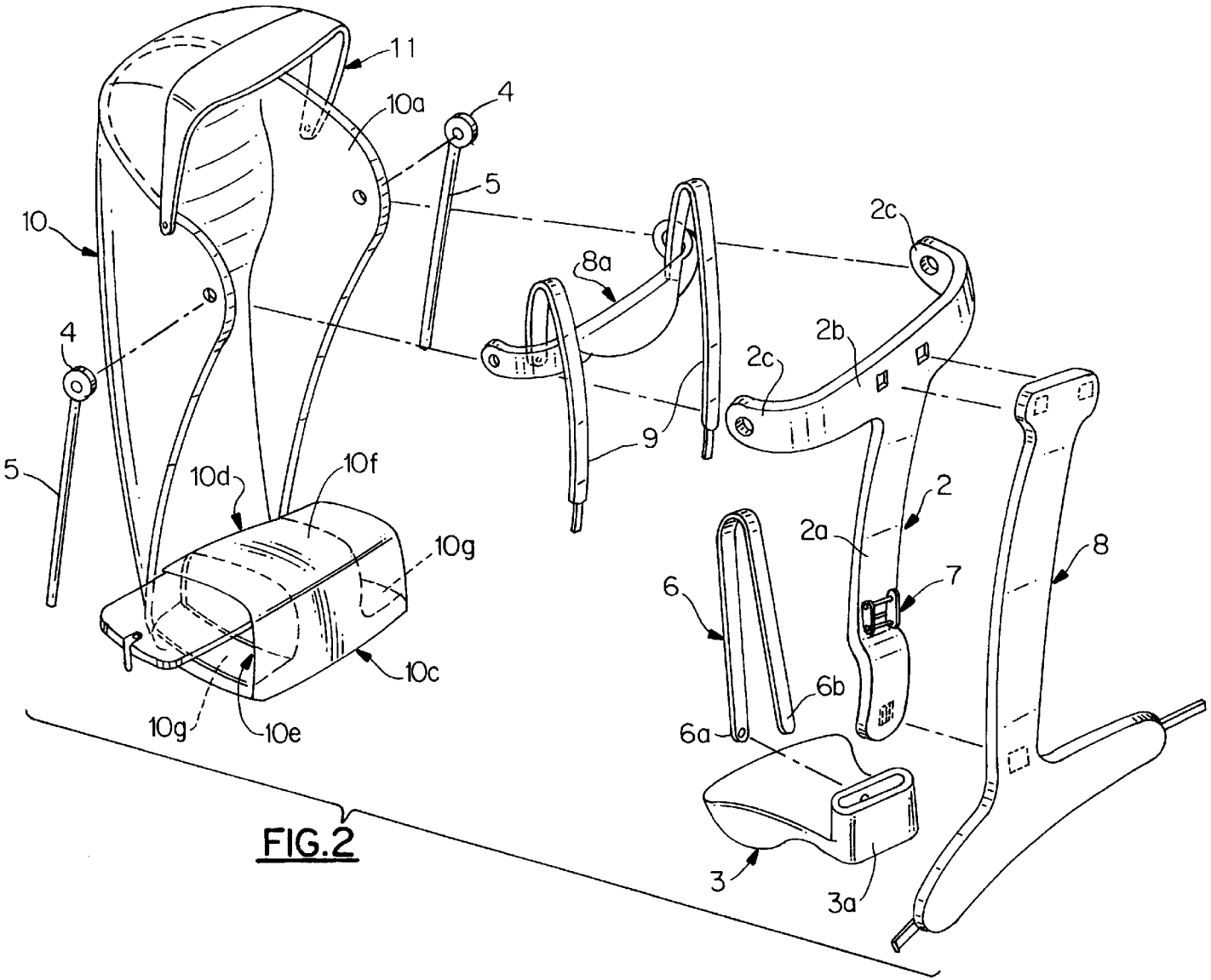
FIG. 2 is a view like FIG. 1 of the backpack baby carrier, its constituent components being separated.
Figure 3:
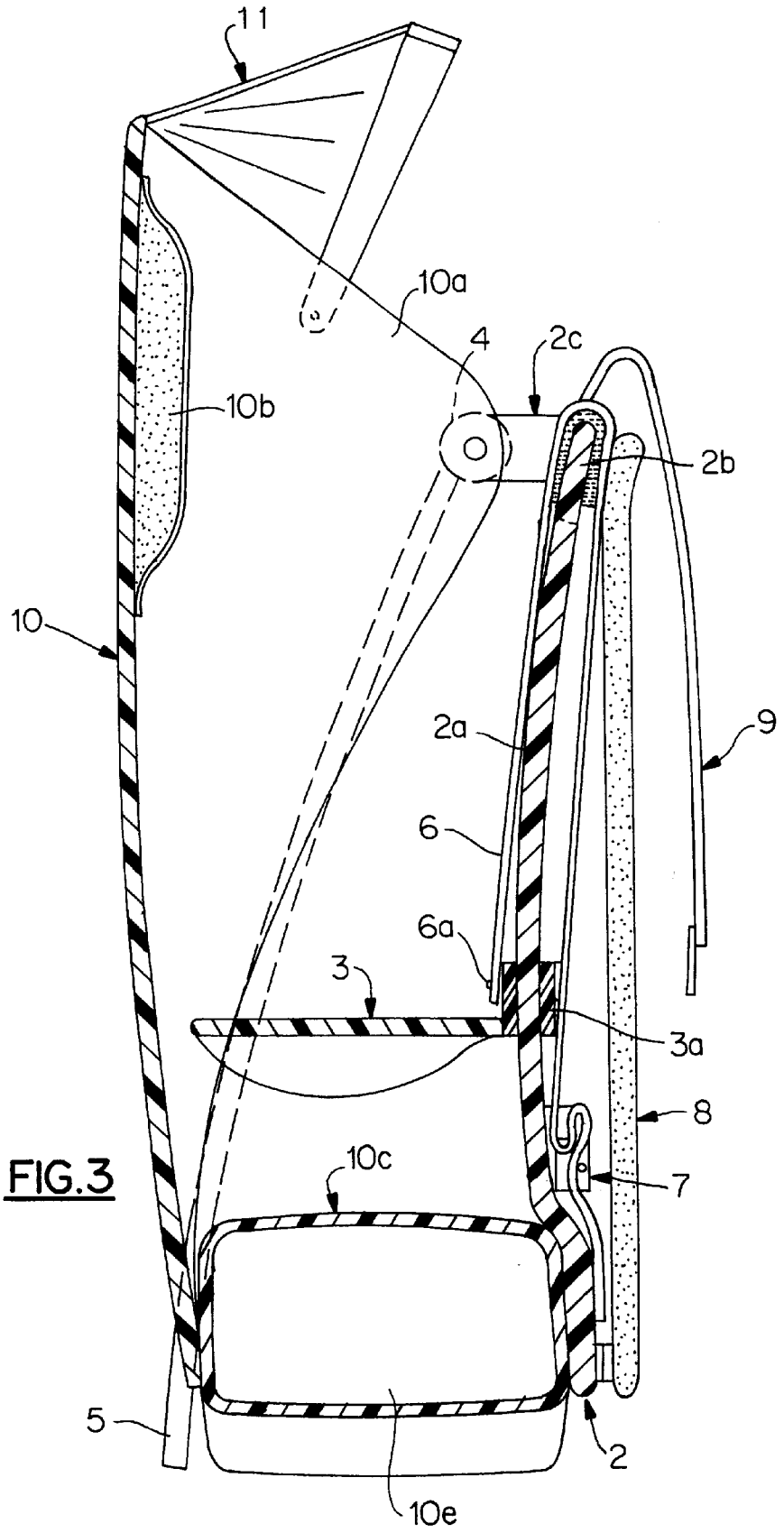
FIG. 3 is a sectional view on A—A as marked in FIG. 1.

In the variant illustrated in broken lines, FIG. 2, said shape (10*d*) is configured by defining a stepped zone giving an upper plane (11*f*) and a lower plane (10*g*) on which the feet of the child can rest, depending on the size of the child.

The thermoformed shell forming the envelope (10) advantageously includes at its top a hood formation (11) that can be folded to protect the child from the sun. Said thermoformed shell has appropriate internal projecting formations for the comfort of the child. This shell is fixed to the support frame with the aid of appropriate connection means connecting in particular to the ends of the upper arm and the lower end of the central arm with the aid of appropriate means allowing a rigid connection of the whole assembly.

Figure 5:
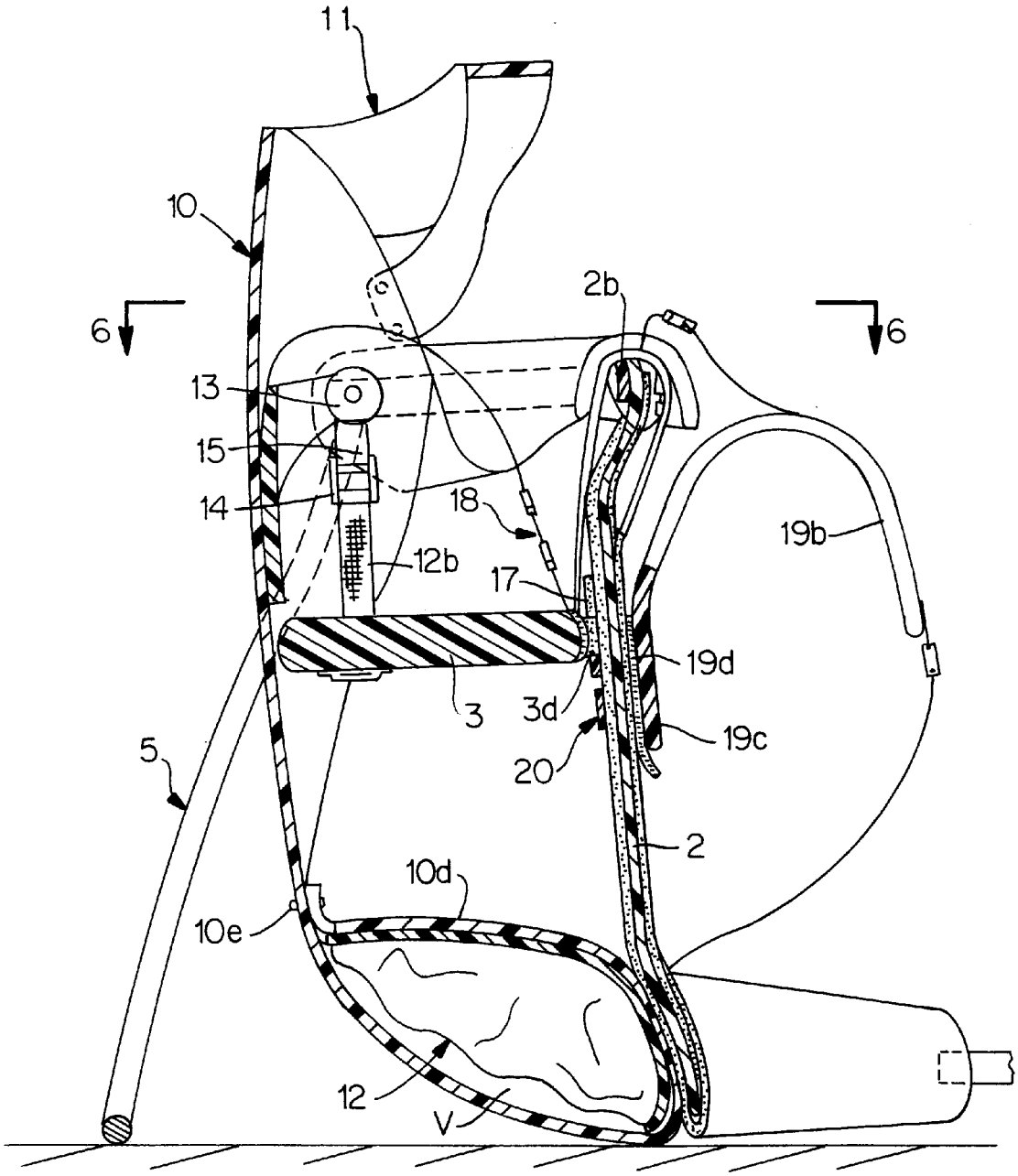
FIG. 5 is a sectional side view illustrating a backpack baby carrier in an alternative embodiment of the adjustable seat positioning means.
Figure 6:
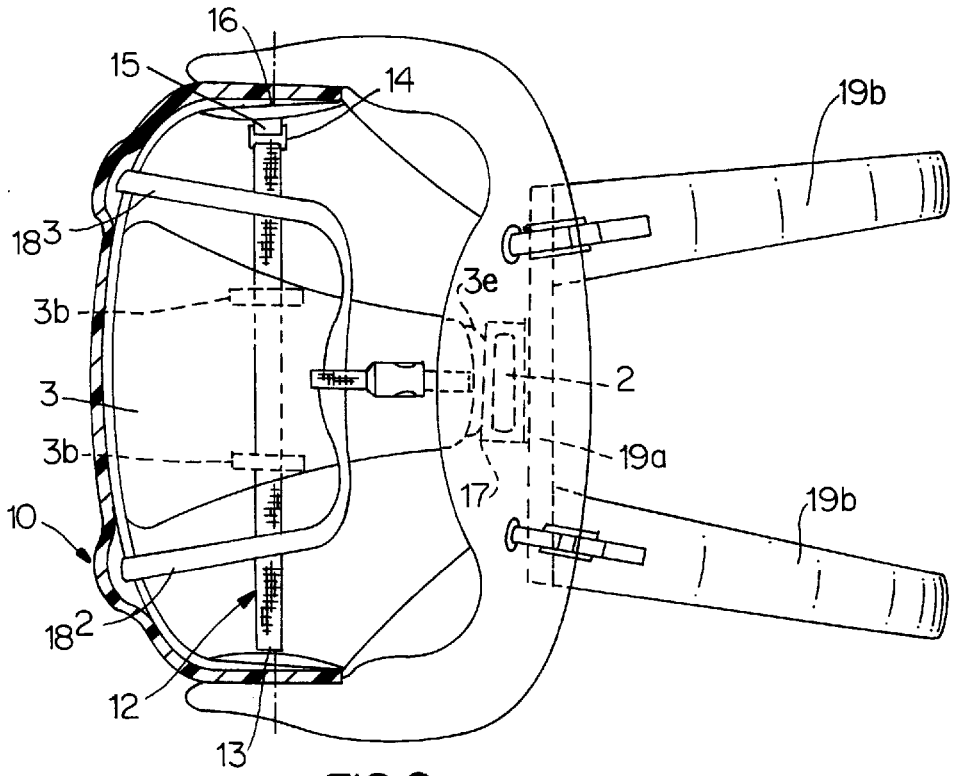
FIG. 6 is a top plan view of the backpack baby carrier of FIG. 5 taken on 6—6 as marked in FIG. 5.
Figure 8:
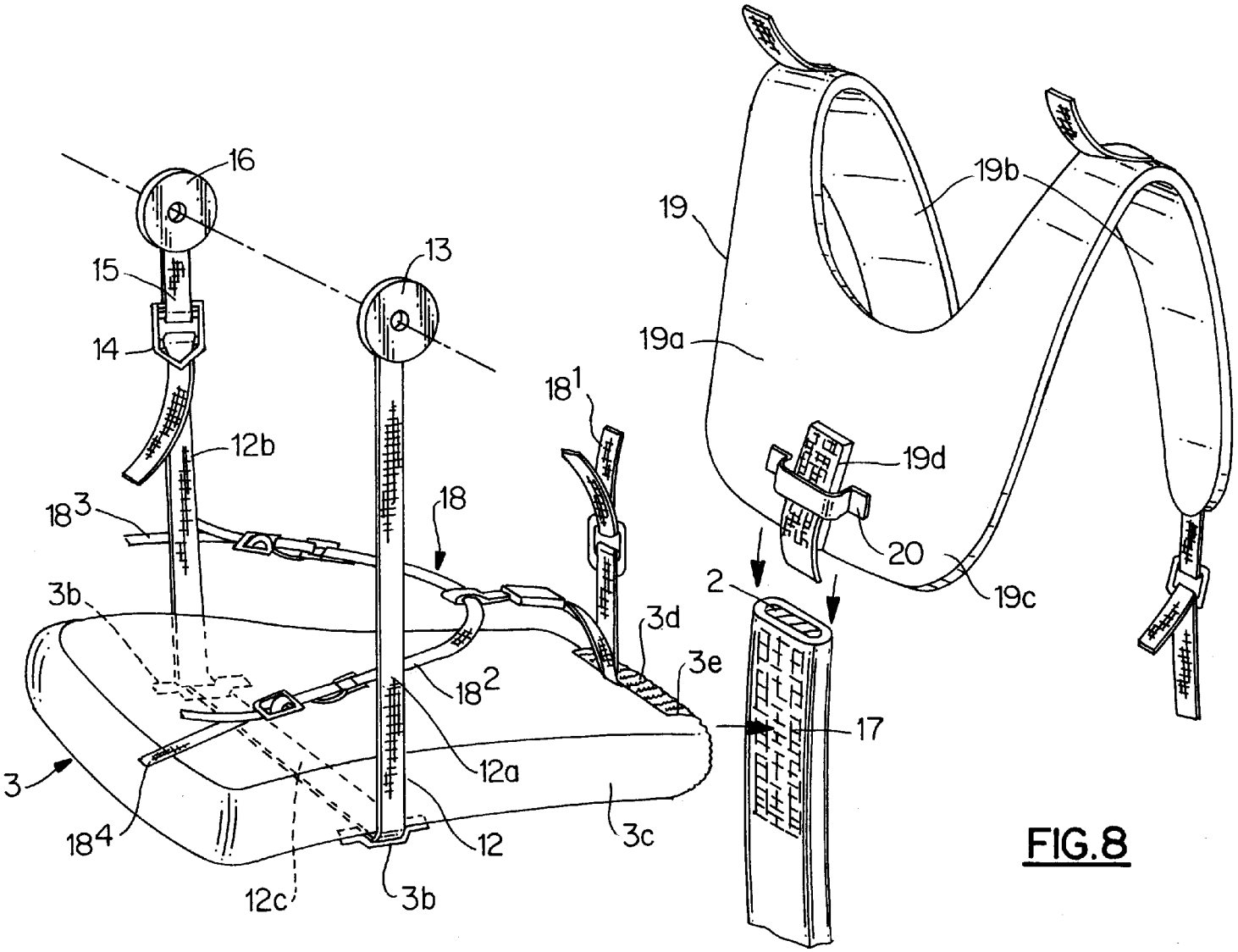
FIG. 8 is an exploded perspective view showing how the seat is suspended with adjustable positioning.

In a variant illustrated in FIGS. 5, 6 and 8, the seat is suspended adjustably relative to the support frame (2) and the enclosing shell (10). More specifically, and with reference to FIG. 8, the seat (3) is constructed at its rear and its lateral edges with two guides (3*b*) for the passage of a strap (12), one part (12*a*) of which is attached to a fixing mount mounted on the shell. The other part (12*b*) of the strap is connected to a buckle (14) which is itself fixed to a tongue (15) on a fastener (16) mounted on the thermoformed shell. The strap thus keeps the seat in position by its central part (12*c*) at a height that can be adjusted according to need. The front part (3*c*) of the seat advantageously has a touch-and-close fixing zone (3*d*) able to engage with a touch-and-close strip (17) laid along the inside surface of the vertical arm of the support frame and surrounding it to form a protective covering.

The seat can therefore be adjusted for position, but also for tilt according to need.

To complete the child's security, a safety harness (18) is provided and has an upper part that fixes around the support frame via the horizontal arm of the latter.

This upper part (18') is connected to a harness part ($\mathbf{18}^2$) joined to two fastening tongues ($\mathbf{18}^3$ and $\mathbf{18}^4$) fixed to the enclosing shell.

The seat (3) comprises a deflection guide (3*e*) at its front, thus retaining the harness. When the latter is put on by the child, it contributes to the positional stability of the seat.

To complement the above, the backpack baby carrier comprises a shoulder strap assembly (19) designed to rest on the shoulders of the wearer. This shoulder strap assembly comprises a support panel (19*a*) extended by two tongues forming shoulder straps (19*b*). The panel comprises on its outer surface (19*c*) a touch-and-close strip (19*d*) able to engage with the opposing touch-and-close part formed on the covering surrounding the vertical arm of the support frame.

A loop (20) maintains the position by engaging around the vertical arm and its covering. The shoulder strap assembly can therefore also be adjustable for position relative to the vertical arm of the support frame.

The baby carrier according to the invention thus has many advantages. In the first place it enables the position of the seat to be adjusted. The support frame can be stood on the ground and gives good support to the child, whether or not it is worn on the back.

Attention is also drawn to the simplicity of the invention, its low cost price and its practical aspect.

What is claimed is:

1. A backpack carrier for a child that includes:

a T-shaped frame having a vertical arm and a horizontal upper arm centrally mounted upon the vertical arm, a seat mounted upon said vertical arm, adjusting means for adjusting the vertical position of said seat upon said vertical arm, said horizontal upper arm containing a connector at opposite ends thereof, a stabilizing means for supporting the frame in an upright position, and shoulder straps attached to said frame whereby said frame can be carried on the back of a person.

2. The backpack of claim 1 that further includes a contoured shell having a vertical back wall and two integral side walls, said side walls connected to the opposing ends of said horizontal arm, said shell encircling said seat and containing a head rest mounted upon the upper part of the back wall and a foot rest mounted on the lower part of the back wall.

3. The backpack of claim 1 wherein said stabilizing means includes a pair of downwardly extended rods that are rotatably mounted in said connectors.

4. The backpack of claim 3 wherein said stabilizing rods are U-shaped members.

5. The backpack of claim 4 wherein said seat is adjustably connected to the vertical arm of said frame by a slide block and further includes a locking means for securing the seat in a selected position.

6. The backpack of claim 5 wherein said seat further includes an adjusting strap attached at one end to the slide block, said adjusting strap passing upwardly over the horizontal arm of the frame and the opposite end of said adjusting strap being adjustably secured to the vertical arm of said frame.

7. The backpack of claim 1 that further includes textile means that is detachably connected to said frame and said back strap.

8. The backpack of claim 2 that further includes a storage compartment mounted upon the lower part of said back wall of said shell and, said foot rest forming a top wall of said compartment.

9. The backpack of claim 8 wherein said compartment is integral with said shell.

10. The backpack of claim 9 wherein said compartment contains at least one open side and further includes a storage bag that is insertable into said compartment through said open side, said storage bag having at least one rigid wall that complements the interior shape of said compartment.

11. The backpack of claim 2 wherein said seat contains strap guides mounted on a bottom surface thereof through which a support strap passes, said support strap extending upwardly on either side of said seat and the ends of said support strap being adjustably connected to the upper part of said shell.

12. The backpack of claim 11 that further includes a closure unit containing pull apart pads mounted on adjacent surfaces of the seat and the vertical arm of the frame.

13. The backpack of claim 2 that further includes a safety harness for securing a child in said backpack, said harness including a first strap connected to the frame and a second strap passing through a loop in said first strap, the ends of said second strap being attached to said shell and adjusting means associated with said straps for adjusting the length of said straps.

14. The backpack of claim 1 that further includes an assembly for said -shoulder straps that includes a support panel integrally joined to a pair of spaced apart tongues that form said shoulder straps, a first tear apart strip mounted upon the panel that extends downwardly to engage a contacting second tear apart strip mounted upon the vertical arm of the frame.

* * * * *